United States Patent [19]

Köppl et al.

[11] 4,383,152

[45] May 10, 1983

[54] CIRCUIT BREAKER

[75] Inventors: Georg Köppl, Birr; Adelbert Rappange, Kleindöttingen, both of Switzerland

[73] Assignee: BBC Brown, Boveri & Company, Limited, Baden, Switzerland

[21] Appl. No.: 177,814

[22] Filed: Aug. 13, 1980

[30] Foreign Application Priority Data

Aug. 15, 1979 [CH] Switzerland ..... 7455/79

[51] Int. Cl.[3] ..... H01H 33/70

[52] U.S. Cl. ..... 200/148 R; 200/148 A

[58] Field of Search ..... 200/148 A, 150 G, 148 R

[56] References Cited

U.S. PATENT DOCUMENTS

| | | | |
|---|---|---|---|
| 3,739,125 | 6/1973 | Noeske | 200/148 A |
| 3,816,684 | 6/1974 | Teijeiro | 200/148 A |
| 4,048,456 | 9/1977 | Noeske | 200/148 A |

*Primary Examiner*—Robert S. Macon

*Attorney, Agent, or Firm*—Burns, Doane, Swecker and Mathis

[57] ABSTRACT

A circuit breaker is disclosed in which a compressed quenching medium, heated by an arc, is rapidly removed from a main duct in such a manner that the arc is effectively blown by axially opposing flows of quenching medium. The circuit breaker includes a nozzle made of an insulating substance and having the main duct. A first contact piece is slidingly accommodated in the main duct, and a second contact piece is fixedly connected to the nozzle. The nozzle includes a first blow duct having a first blow orifice, and an exhaust duct having an exhaust orifice. A second blow duct having a second blow orifice is included between the nozzle and the second contact piece. The first and second blow orifices are axially spaced from each other, and the exhaust orifice is located between the first and second blow orifices.

7 Claims, 7 Drawing Figures

CIRCUIT BREAKER

Figure 1:
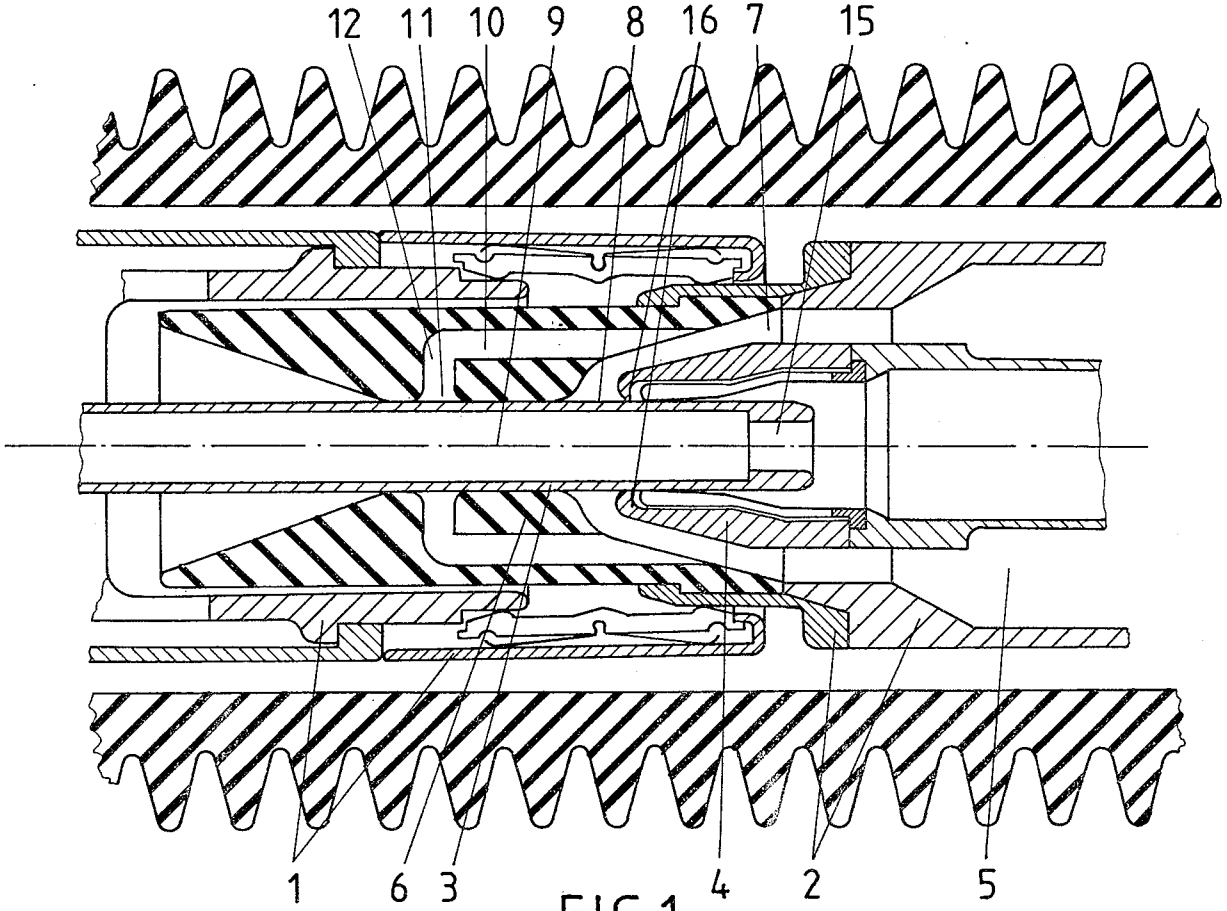

The present invention concerns a circuit breaker with a device for the compression of quenching media and with a nozzle for an insulating substance having in the main duct of the nozzle at least one orifice of at least one blow duct, and with a first contact piece sliding in the main duct and a second contact piece movable with respect to said first contact piece, forming together with the nozzle for the insulating substance a second blow duct with its orifice axially offset in relation to the orifice of the first blow duct, whereby upon the interruption of the circuit compressed insulating medium is blown into the main duct.

A circuit breaker of the abovementioned type is known from DE-OS No. 27 10 868. In this circuit breaker an additional radial blast of the arc is effected through blow ducts provided in the nozzle for the insulating medium, but the hot quenching gases are forced to flow axially through the entire main duct of the insulating medium nozzle in a direction determined by the motion of the contact pieces.

It is further known from CH-P No. 519 780 to increase the breaking capacity of a compressed gas circuit breaker by means of the double blowing of the breaker arc struck between the contact pieces, but in a circuit breaker of this type an increase in the breaking capacity may be obtained only by the use of several disconnecting locations.

The compressed gas circuit breaker described in DE-AS No. 1 240 159 with a nozzle for the insulating medium has at the narrowest point of the body of the nozzle a plurality of lateral outlet orifices for the quenching medium. This reduces the driving force in the breaking of large currents, but the blowing of the breaker arc and thus the breaking capacity are not at an optimum level in such an arrangement.

It is the object of the invention to improve the blowing of the breaker arc in a circuit breaker of the abovementioned type and to thereby increase its breaking capacity.

The object of the invention is attained by providing at least one orifice of at least one exhaust duct between the orifices of the first and the second blow ducts, whereby a first portion of the quenching medium is removed from the main bore as soon as the first contact piece uncovers the opening. The measures according to the invention not only effect the rapid removal of the hot quenching gases from the main bore and rapidly conduct cool quenching gases to the arc, but also induce axial flows of the quenching medium in opposing directions at the location of the arc, which result in a favorable turbulence of the arc and simultaneously in the intensive blowing of the footing points of the arc.

In the drawing, an example of embodiment of the object of the invention is presented in a simplified manner, wherein similar parts are designated by identical reference numbers in all of the drawings.

Figure 2C:
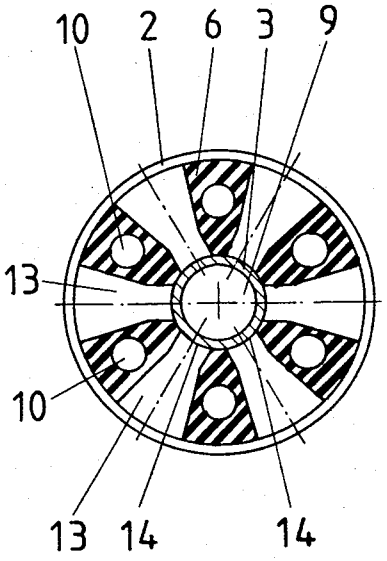
Figure 2B:
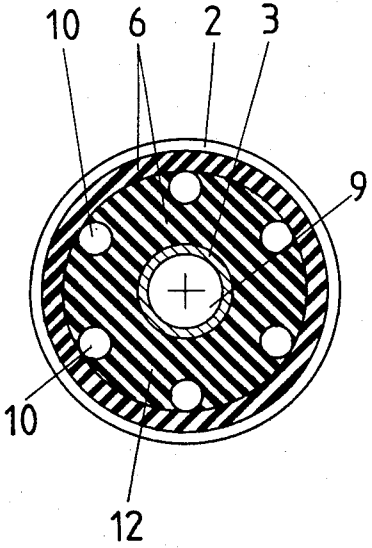
Figure 2A:
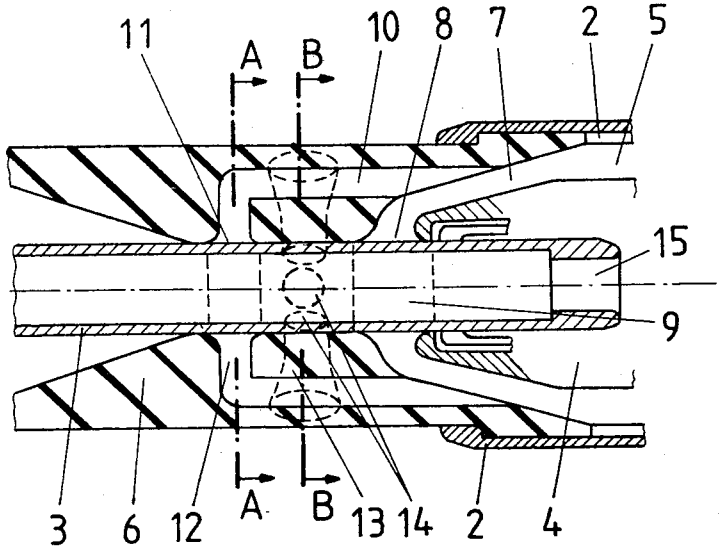
Figure 3:
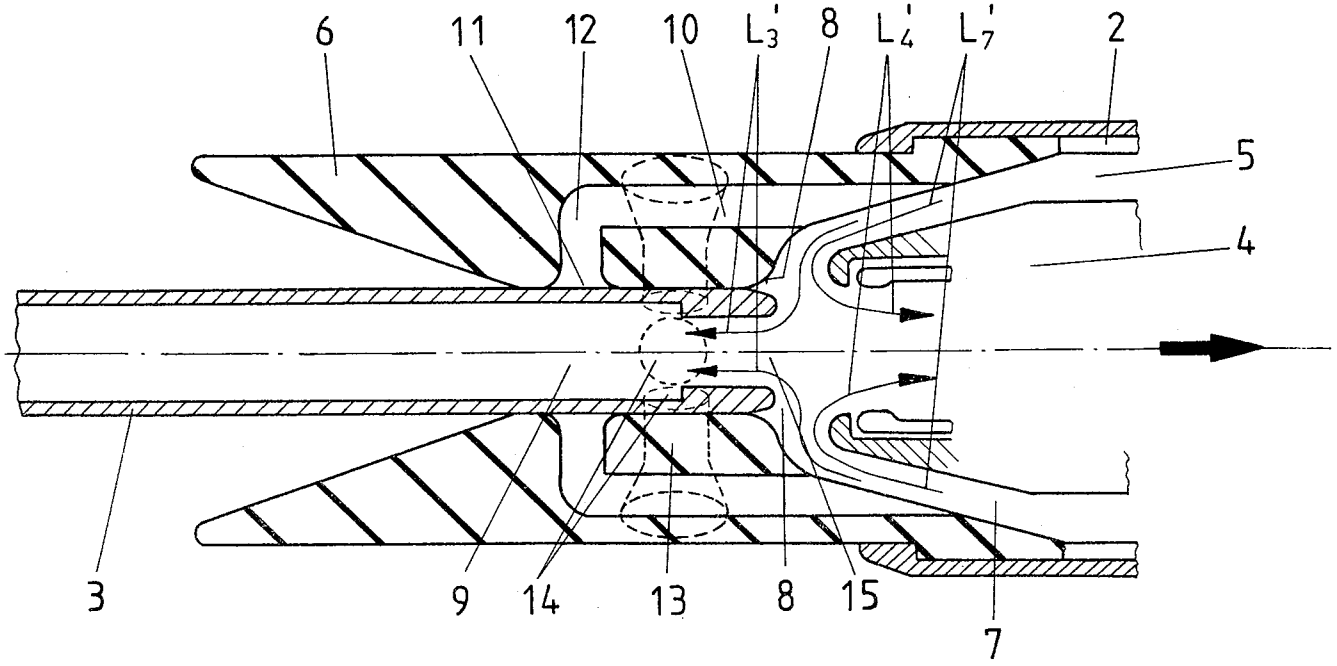
Figure 4:
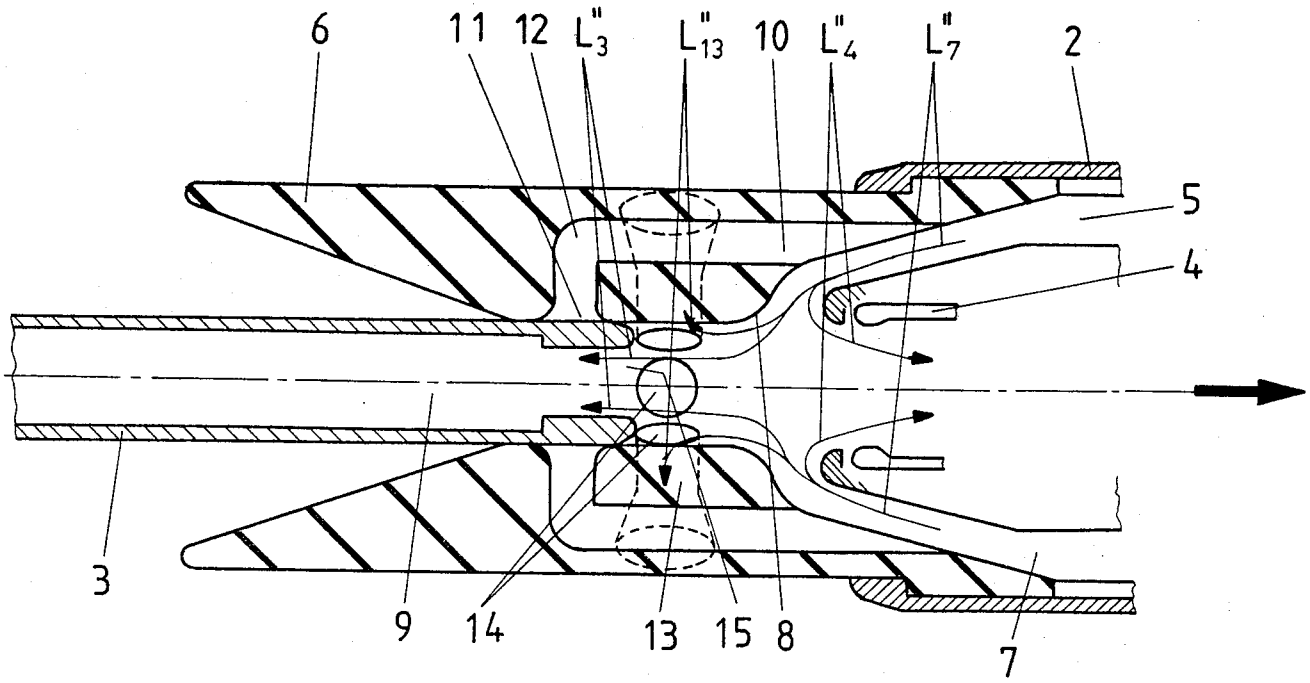
Figure 5:
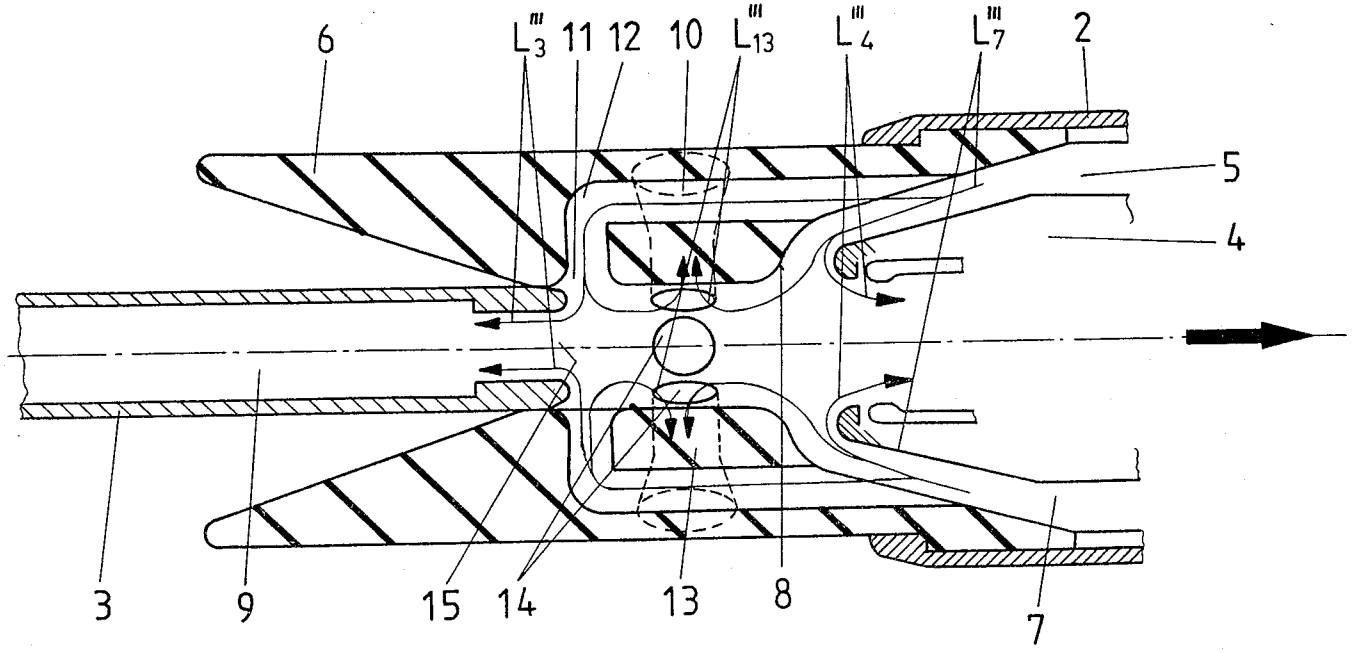

In the drawing,

FIG. 1 shows an axial section through the contact arrangement of the circuit breaker according to the invention, FIG. 2*a* axial section through the nozzle for the insulating substance and the contact pieces of the contacting arrangement according to FIG. 1, wherein invisible lines are presented in part by broken lines, FIG. 2*b* a section through the arrangement according to FIG. 2*a* along the line A—A, FIG. 2*c* a section through the arrangement according to FIG. 2*b* along the line B—B and FIG. 3 to 5 axial sections through the arrangement according to FIG. 2*a* during different opening phases of the contact pieces.

FIG. 1 represents an contact arrangement located in a quenching medium chamber. Herein, 1 designates a stationary constant current contact and 2 a mobile constant current contact. The symbol 3 refers to a stationary contact piece provided in the axial direction with a duct and having at its end facing a mobile contact 4 an orifice 15 in the shape of a nozzle. This contact piece 3 protrudes into an orifice, again of a nozzle like configuration, 16, of the mobile contact piece 4, which is also provided in the longitudinal direction with a duct. The mobile contact pieces 2 and 4 simultaneously are a part of a compression device, not shown, whereby in the case of the interruption of the current the quenching media—possibly gaseous $SF_6$—are compressed in the blow chamber 5 and are exiting after the separation of the two contact pieces 3 and 4 through a blow duct 7, formed by a nozzle 6 for the insulating substance and the mobile contact 4, from the orifice 8 of the blow duct 7, and thus are able to blow onto the arc, not shown. The nozzle for the insulating substance 6, coupled with the mobile contact piece 4, has a main duct 9, wherein the stationary contact piece 3 is able to slide. In the main duct 9, the orifices 11 of blow ducts are provided; with said ducts consisting of an annular space 12 and of partial ducts 10, opening into the annular space and extending in an approximately axial direction. The partial ducts 10 are branching off the blow duct 7 and are located, together with the annular space 12, within the nozzle 6 for the insulating substance.

In FIG. 2*a* and 2*c* additionally six, symmetrically arranged exhaust ducts 13 are shown; these ducts open into orifices 14 in the main duct 9. These exhaust ducts connect the main duct 9 and the quenching medium chamber located outside the nozzle 6 of the insulating substance and not shown in the figures, and extend preferably in the radial direction. It is also possible not to extend the exhaust ducts 13, as shown in the radial direction outside the nozzle 6, but to divert them prior to their reaching the outside of the nozzle in the axial direction inside the nozzle and to conduct them on the side of the nozzle 6 facing away from the blow duct 7 into the quenching medium chamber.

As seen in FIG. 2*c*, the exhaust ducts 13 are arranged axially at an identical height, wherein an exhaust duct 13 is provided between every two blow ducts 10, 12.

The mode of operation of the circuit breaker according to the invention is as follows.

In FIG. 2, the current to be interrupted flows through the closed constant current contacts 1, 2. The pressure of $SF_6$ gas in the quenching medium chamber has the same value as the pressure of the $SF_6$ gas in the blow chamber 5.

In the case of interruption, the mobile constant current contact 2, together with the mobile contact piece 4 and the nozzle 6 of the insulating substance moves in the direction indicated by the arrow in FIG. 3. The compressed $SF_6$ gas $L_7'$ is thereby conducted, after the separation of the two contact pieces 3 and 4, through the blow duct 7 to the point of separation of the two contact pieces 3, 4. At this point of separation, the flow $L_7'$ of the gas is divided into two opposingly directed gas flows $L_3'$ and $L_4'$, which are flowing at a high velocity in the axial direction through the nozzle shaped orifices 15, 16 of the two contact pieces 3 and 4 and are exhausted through ducts provided in the contact pieces 3,4 into the quenching medium chamber, which is under a pressure lower than that prevailing in the blow chamber 5. By means of the $SF_6$ gas flows $L_3'$ and $L_4'$, the arc struck between the contact pieces 3 and 4—not shown in the figures—is exposed highly effectively to double blasts.

In the course of the further motion of the mobile contact 2,4 in the direction indicated, according to FIG. 4, the orifices 14 of the exhaust ducts 13 are uncovered, so that a portion $L_{13}''$ of the inflowing $SF_6$ $L_7''$ is able to escape through these exhaust ducts. Additional portions $L_3''$ and $L_4''$ of the gas to be exhausted are removed in accordance with FIG. 3, through the hollow contact pieces 3 and 4. The favorable combination of axial and radial double blows obtained in this manner results in a particularly vigorous blasting of the footing points of the arc.

During the continued disconnecting motion, according to FIG. 5, finally the orifice 11 of the blow duct 10, 12 is uncovered. The arc is now exposed to a quadruple blow of the $SF_6$ gas exiting from the blow duct 7 and the annular space 12. The exhaust gases $L_3'''$, $L_4'''$ and $L_{13}'''$ are removed after the blow through the ducts of the contact pieces 3,4 and the exhaust ducts 13. By means of this blow, the arc is made turbulent over its entire length with particular effeciency so that it may be extinguished even in the case of very strong short circuit currents.

It is further possible to provide additional axially displaced orifices of blow ducts in the main duct 9 an to arrange between every two axially offset orifices at least one orifice of an exhaust duct. By means of such measures, it is possible to direct six, eight or even more blows at the breaker arc and thus to obtain an improved quenching effect. It is also possible not to have the blow ducts opening annularly into the main duct, but to conduct them in the form of separate ducts into the main duct.

We claim:

1. A circuit breaker having means for compressing a quenching medium, comprising:

a nozzle member, said nozzle member being made of an insulating material and having a main duct;

a first contact piece, said first contact piece being slidingly accommodated in said main duct;

a second contact piece, said second contact piece being fixedly connected to said nozzle member;

a first blow duct, said first blow duct being included in said nozzle member and having a first blow orifice located at a first axial location;

a second blow duct, said second blow duct being included between said nozzle member and said second contact piece and having a second blow orifice located at a second axial location, said second axial location being spaced from said first axial location; and an exhaust duct, said exhaust duct being included in said nozzle member and having an exhaust orifice located at a third axial location, said third axial location being disposed between said first and second axial locations;

wherein when current flows through the circuit breaker said first and second blow orifices and said exhaust orifice are each covered by said first contact piece; and further wherein, when said current flow is interrupted, quenching medium is blown into said blow ducts and said first and second contact pieces move relative to each other such that said first and second blow orifices and said exhaust orifice are uncovered so that said quenching medium is blown through said first and second blow orifices and into said main duct, a first portion of said quenching medium being exhausted from said main duct through said exhaust orifice.

2. The circuit breaker of claim 1:

wherein said first contact piece includes a first duct terminating in a first orifice and said second contact piece includes a second duct terminating in a second orifice; and further wherein, when said current flow is interrupted said first and second contact pieces move relative to each other such that said first and second orifices are opposed to and spaced from each other so that a second portion of said quenching medium is exhausted from said main duct through said first orifice and said first duct and a third portion of said quenching medium is exhausted from said main duct through said second orifice and said second duct.

3. The circuit breaker of claim 1 or claim 2 wherein said first and second orifices are annular.

4. The circuit breaker of claim 3 wherein said nozzle member further includes:

an annular region in fluid communication with said first blow orifice; and at least one partial duct in fluid communication with said annular region.

5. The circuit breaker of claim 4:

wherein said at least one partial duct includes first and second substantially axially disposed partial ducts;

wherein said exhaust duct further includes first and second substantially radially disposed exhaust ducts; and further wherein, said first exhaust duct is in fluid communication with said first partial duct and said second exhaust duct is in fluid communication with said second partial duct.

6. The circuit breaker of claim 4:

wherein said at least one partial duct includes first and second axially disposed partial ducts;

wherein said exhaust duct further includes first and second exhaust ducts, each of said first and second exhaust ducts having a substantially axial duct member; and further wherein, said first exhaust duct is in fluid communication with said first partial duct and said second exhaust duct is in fluid communication with said second partial duct.

7. The circuit breaker of claim 1:

wherein said first blow duct includes a plurality of axially spaced blow orifices; and further wherein, said exhaust duct includes a plurality of axially spaced exhaust ducts, said exhaust ducts being disposed relative to said blow orifices such that at least one exhaust duct is located between every two axially adjacent blow orifices.

* * * * *